United States Patent [19]

Frobose

[11] Patent Number: 4,573,740

[45] Date of Patent: Mar. 4, 1986

[54] UPHOLSTERED SEAT FOR CLEAN ROOM

[75] Inventor: James W. Frobose, Haskins, Ohio

[73] Assignee: The Jasper Corporation, Easton, Md.

[21] Appl. No.: 621,714

[22] Filed: Jun. 18, 1984

Related U.S. Application Data

[63] Continuation-in-part of Ser. No. 551,914, Nov. 15, 1983, and Ser. No. 551,913, Nov. 15, 1983.

[51] Int. Cl.[4] ..... A47C 7/18

[52] U.S. Cl. ..... 297/452; 297/180; 297/DIG. 1; 297/DIG. 3; 5/468

[58] Field of Search ..... 297/452, 180, DIG. 1, 297/DIG. 2, DIG. 3, 455; 5/467, 468, 481

[56] References Cited

U.S. PATENT DOCUMENTS 3,792,501 2/1974 Kery ..... 297/DIG. 3

4,204,657 5/1980 Graham ..... 297/DIG. 3

4,445,241 5/1984 Ender et al. ..... 5/468

FOREIGN PATENT DOCUMENTS 1144450 2/1963 Fed. Rep. of Germany ..... 5/468

389651 1/1974 U.S.S.R. ..... 297/DIG. 3

*Primary Examiner*—William E. Lyddane

*Assistant Examiner*—Mark W. Binder

*Attorney, Agent, or Firm*—Brady, O'Boyle & Gates

[57] ABSTRACT

To assist in maintaining the high degree of cleanliness required by Federal standards in industrial clean rooms, an upholstered seat is provided having an attached bellows which receives air from the seat when the seat is compressed and from which air is returned to the seat as the seat expands. There is no escape of air from the seat and bellows to the atmosphere and no induction of air from the atmosphere to the seat or bellows.

5 Claims, 4 Drawing Figures

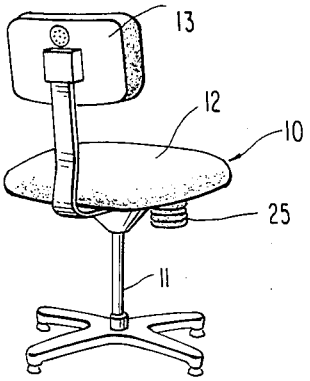
FIG. 1
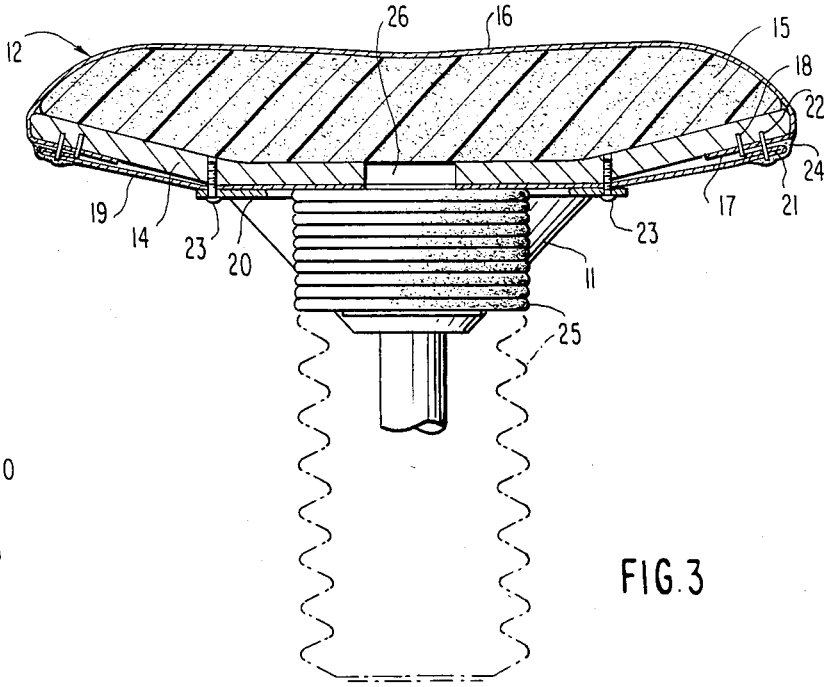
FIG. 3
FIG. 2
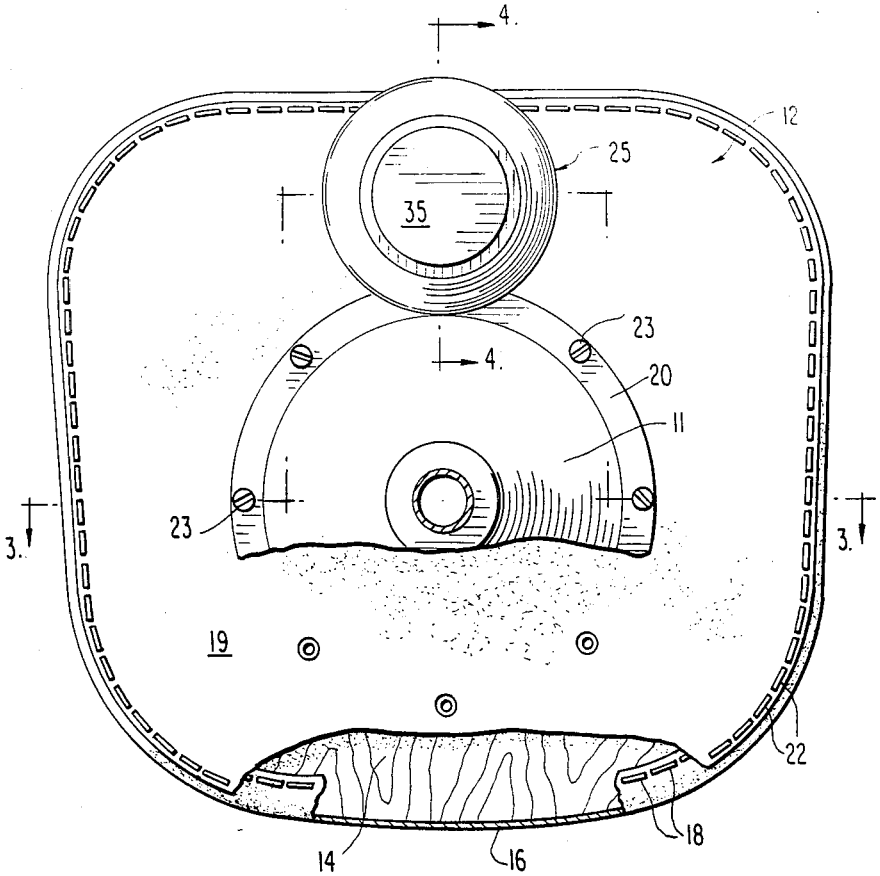

UPHOLSTERED SEAT FOR CLEAN ROOM

CROSS-REFERENCE TO RELATED APPLICATIONS

This application is a continuation-in-part of my co-pending application Ser. No. 06/551,914, pending 350 filed Nov. 15, 1983 and my co-pending Appln. Ser. No. 06/551,913, filed Nov. 15, 1983.

BACKGROUND OF THE INVENTION

The manufacture of microchips and some other industrial products has created a necessity for an extreme degree of cleanliness in manufacturing facilities, commonly called clean rooms. As a result of these cleanliness requirements, Federal standards have been promulgated and must be strictly complied with by the industries involved. Current Federal Standard No. 209B pertaining to classes of room cleanliness establishes three classes of clean rooms, Class 100 being the strictest of these classes. Class 100 specifies that only 100 particles of 0.5 micron size or larger are allowed per cubic foot of air in the clean room. The standard does not pertain to merely an average foot of air but to any cubic foot, at any time. Suggested air velocities are also listed for each class under Federal Standard No. 209B.

A main object of the present invention is to fully comply with and substantially exceed the requirements of Class 100 under Federal Standard No. 209B, in connection with upholstered furniture for clean room use, such as chairs, stools and other seat structures.

Presently, no conventional upholstered furniture or wooden furniture can be tolerated in clean rooms because of the micro particles expelled by them into the environment during normal usage. Such furniture falls far short of even the most liberal class under Federal Standard No. 209B, namely Class 100,000. Metal furniture, such as furniture made entirely of stainless steel, can meet the Federal standards but such furniture becomes so uncomfortable during long usage as to be intolerable, and does not represent a complete solution to the problem.

A further object of the present invention is to provide comfortable upholstered furniture, including various types of seats for clean room usage which fully comply with and exceed the cleanliness requirements under Federal standards of self-imposed industrial standards.

Another and more specific object of the invention is to provide an upholstered seat or other upholstered body supporting surface having a yielding cushion, a hard support base for the cushion and hermetically sealed air-impermeable coverings for the cushion and support base; there being a flexible expandable and collapsible air-impermeable vessel in communication with the interior of the cushion and closed to the atmosphere.

Other features and advantages of the invention will become apparent to those skilled in the art during the course of the following detailed description.

BRIEF DESCRIPTION OF THE DRAWINGS

FIG. 1 is a perspective view of an upholstered clean room chair according to the invention.

FIG. 2 is an enlarged bottom plan view of the seat portion of the chair, partly in cross-section and partly broken away.

FIG. 3 is a vertical section taken on line 3—3 of FIG. 2, parts in elevation.

DETAILED DESCRIPTION

Figure 4:
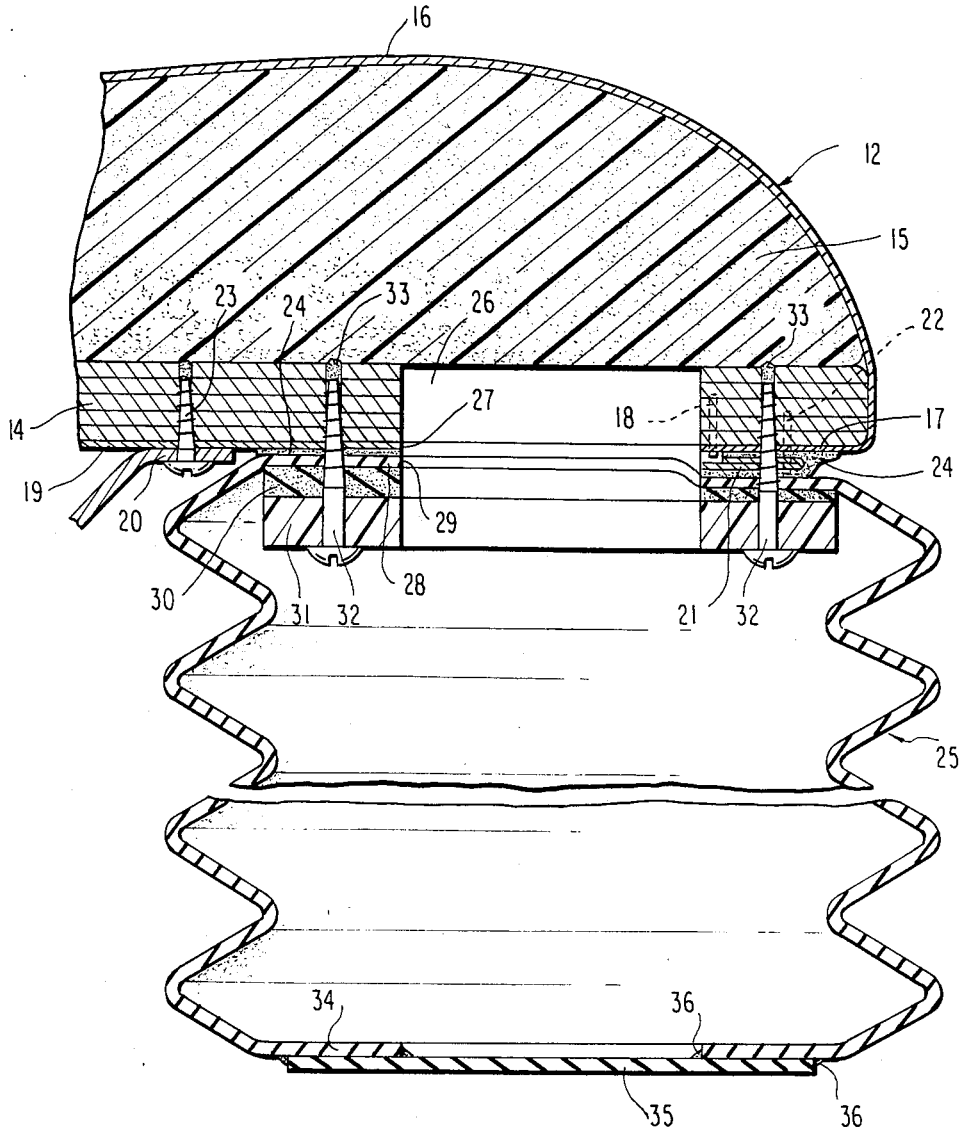
FIG. 4 is an enlarged fragmentary vertical section taken on line 4—4 of FIG. 2.

Referring to the drawings in detail, wherein like numerals designate like parts, a typical upholstered clean room technician's chair 10 according to the present invention is shown in FIG. 1. The invention is also applicable to other types of clean room upholstered furniture including stools, benches and the like. The chair 10 includes a metal pedestal 11, an upholstered seat 12 constructed in accordance with the invention, and an appropriate backrest 13. In some cases, the subject matter of the invention can also be embodied in the backrest or other upholstered body supporting surface of furniture.

In accordance with the invention, the upholstered seat 12 comprises a rigid preferably contoured base panel 14 formed of wood or the like, on the upper surface of which is mounted a resilient cushion 15 formed of foam rubber or foam plastics material. An air-impermeable preferably vinyl top cover section 16 entirely encloses the seat cushion 15 above the rigid panel member 14 and has its marginal portion 17 folded inwardly beneath the panel member 14 and attached thereto by a first line of staples 18.

A lower air-impermeable preferably vinyl seat cover section 19 extends beneath the base panel 14 and between it and a top mounting flange 20 of the pedestal 11. The marginal portion of the cover section 19 is folded upon itself to provide a double thickness margin 21 for the lower over section and this double thickness margin is secured directly to the bottom of the marginal portion 17 by a second line of staples 22. Screws 23 are employed to secure the pedestal flange 20 to the base panel 14 rigidly.

To render the upholstered seat structure thus far described completely air-tight, continuous adhesive sealant 24 is applied around the margin of the double thickness portion 21 of the lower cover section 19 and between the portions 21 and 17 in the region of the staples 22, as best shown in FIG. 4. The screws 23 are also dipped in adhesive solvent before application to the flange 20 and base panel 14.

In accordance with the principal feature of the invention, a bellows 25 formed of rubber or rubber-like material is mounted in communication with the interior of the upholstered seat 12 in such a manner that the air contained in the seat cushion 15 can be expelled into the bellows when the upholstered seat is compressed, and the same air within the bellows is inducted into the seat cushion as the upholstered seat is relieved of its load and expands. The upholstered seat and bellows are completely sealed relative to the outside atmosphere so that no atmospheric air can enter the bellows or upholstered seat and no air contained in the seat and bellows can be expelled to the atmosphere. This completely eliminates pollution of the clean room atmosphere by the air contained within the upholstered furniture during its usage in a clean room.

The bellows which may be circular in cross section or a different shape, if preferred, is spaced forwardly of the pedestal 11 and located substantially flush with the front edge of the seat 12 at its transverse center. The base panel 14 adjacent to the bellows has an opening 26 through which air flows from the upholstered seat into the bellows and vice-versa. The lower vinyl cover section 19 has a registering opening 27 and the top wall 28 of the bellows 25 also has a registering opening 29. A compressible ring gasket 30 and rigid ring 31 are placed below the bellows top wall 28 with their bores in registry with the openings 26, 27 and 29. These elements 30 and 31 are disposed inside of the air-impermeable bellows.

Bellows attaching screws 32 dipped in adhesive sealant 33 are placed through the ring 31, gasket 30, bellows top wall 28, lower cover section 19 and into the rigid base panel 14. The previously-described sealant 24 is also disposed between the bellows top wall 28 and lower cover section 19, as best shown in FIG. 4. The upholstered seat and bellows assembly is thus completely hermetically sealed.

The lower end wall 34 of the bellows 25 is closed by a disc 35 of rubber installed after completion of the assembly. This closure disc is also sealed by adhesive sealant 36.

It should now be apparent that the bellows 25 forms a flexible expandable and collapsible vessel sealed from the ambient atmosphere and always in open communication with the interior of the air-impermeable upholstered seat. Thus, whenever the seat is compressed by a user, the air contained therein is expelled into the bellows 25, and later, when the seat is relieved of its load and returns to its normal shape, the air previously expelled into the bellows is returned into the seat 12. This action takes place with absolutely no contamination of the clean room atmosphere.

The terms and expressions which have been employed herein are used as terms of description and not of limitation, and there is no intention, in the use of such terms and expressions, of excluding any equivalents of the features shown and described or portions thereof but is is recognized that various modifications are possible within the scope of the invention claimed.

I claim:

1. In upholstered furniture for industrial clean rooms, a body support portion comprising a substantially rigid panel member, a yielding cushion on and substantially covering a top face of said panel member, an air impermeable sheet material cover for said body support portion surrounding and enclosing said panel member and cushion and being in hermetically sealed relationship to said panel member, said panel member and cover having substantially registering openings formed therethrough, and an expandable and collapsible air impermeable vessel located on the bottom face of said panel member and secured to the body support portion on the exterior of said cover, said vessel having its interior in communication with the body support portion through said registering openings and being in hermetically sealed relationship with the panel member and said cover, whereby air can enter and leave said body support portion by passing into and out of said vessel to thereby prevent the escape of air and particles internal of the body support portion into the air external of the body support portion.

2. In upholstered furniture for industrial clean rooms as defined in claim 1, and said vessel comprising an elastic bellows.

3. In upholstered furniture for industrial clean rooms as defined in claim 2, and said body support portion comprising a seat member in which said cushion is disposed above said panel member and said elastic bellows depends substantially vertically from the seat member and panel member.

4. In upholstered furniture for industrial clean rooms as defined in claim 3, and said bellows having a top end wall lying against said cover adjacent to the bottom face of the panel member and being hermetically sealed to the cover around said registering openings, a substantially rigid ring and a compressible gasket within the bellows beneath said top end wall of the bellows, and fastener elements penetrating said ring, gasket, top end wall, cover and panel member.

5. In upholstered furniture for industrial clean rooms as defined in claim 1, and said cover comprising a first cover section spanning said cushion and extending around the marginal edges of the cushion and panel member and overlapping the surface of the panel member away from the cushion, and a second cover section spanning the surface of the panel member away from said cushion and having a folded marginal edge portion of double thickness lying adjacent to the portion of the first cover section which overlaps said surface of the panel member and being hermetically sealed to such portion of the first cover section and hermetically sealed to said vessel.

* * * * *